United States Patent [19]

Anghinetti et al.

[11] 4,104,834

[45] Aug. 8, 1978

[54] FIRE VENT

[75] Inventors: Joseph R. Anghinetti, Kennebunkport; Paul A. Couture, Emery Mills, both of Me.

[73] Assignee: Wasco Products, Inc., Sanford, Me.

[21] Appl. No.: 726,578

[22] Filed: Sep. 27, 1976

Related U.S. Application Data

[62] Division of Ser. No. 531,808, Dec. 11, 1974, Pat. No. 4,068,417, which is a division of Ser. No. 341,780, Mar. 15, 1973, abandoned.

[51] Int. Cl.[2] ..... L05F 15/20

[52] U.S. Cl. ..... 52/1; 49/3; 49/4; 49/7

[58] Field of Search ..... 52/1; 49/1–4, 49/6, 7, 8, 25, 31

[56] References Cited

U.S. PATENT DOCUMENTS

| | | | |
|---|---|---|---|
| 712,256 | 10/1902 | Bamberger | 49/7 |
| 1,864,357 | 6/1932 | Kelly | 49/7 |
| 2,803,319 | 8/1957 | Johnson | 49/1 |
| 2,812,835 | 11/1957 | Smiley | 49/7 |
| 2,827,003 | 3/1958 | Stetson | 49/1 |
| 2,842,809 | 7/1958 | Shaver | 49/401 |
| 3,115,224 | 12/1963 | Machamer | 49/1 |
| 3,207,273 | 9/1965 | Turin | 49/7 |
| 3,337,990 | 8/1976 | Yoshiaki | 49/4 |
| 3,438,147 | 4/1969 | Lander | 49/7 |
| 3,453,777 | 7/1969 | Reilly | 49/31 |
| 3,516,210 | 6/1970 | Jentoft | 49/8 |
| 3,557,497 | 1/1971 | Schafer | 52/1 |
| 3,589,065 | 6/1971 | Watson | 49/7 |
| 3,757,471 | 9/1973 | Dougherty | 52/1 |
| 3,777,241 | 12/1973 | Wenger | 49/31 |
| 3,955,323 | 5/1976 | Harmathy | 52/1 |

FOREIGN PATENT DOCUMENTS

| | | | |
|---|---|---|---|
| 222,468 | 9/1968 | Sweden | 49/7 |
| 403,294 | 12/1933 | United Kingdom | 49/401 |
| 776,843 | 1/1957 | United Kingdom | 49/3 |
| 1,198,535 | 7/1970 | United Kingdom | 49/4 |

*Primary Examiner*—Ernest R. Purser
*Assistant Examiner*—Henry Raduazo
*Attorney, Agent, or Firm*—Wolf, Greenfield & Sacks

[57] ABSTRACT

A wall vent preferably for use in a high-rise building is releasably opened for venting a fire in the building. The vent comprises a frame, a window or venting panel that is pivotally supported on one of its sides, means for biasing the venting panel to an open position and latch means for maintaining the panel in a closed position. The latch means may be either manually or electrically released or released upon detection of heat or smoke, and may be released either at the panel or remotely. Each wall vent is also preferably releasable to an open position from a story of the building therebelow.

8 Claims, 17 Drawing Figures

FIRE VENT

RELATED APPLICATIONS

This is a division of application Ser. No. 531,808, filed Dec. 11, 1974, now U.S. Pat. No. 4,068,417 which is a division of Ser. No. 341,780 filed Mar. 15, 1973, now abandoned.

FIELD AND BACKGROUND OF THE INVENTION

The present invention relates in general to a vent for use in a building for venting a fire within the building. More particularly, the present invention is concerned with a pivotal wall vent that is normally secured in a closed position but that is releasable either manually or automatically to an open position for venting a fire within the building.

In many of the larger buildings now constructed, the basic structure of the building is essentially fire-proof but many times the contents that are stored in the building may not be fore-proof. When a fire starts within a section of the building smoke can spread throughout the building or at least throughout an area of the building and can cause a pantic. Many of these high rise buildings are also provided with air-conditioning or heating ducts through which at least the smoke can spread.

In order to alleviate this problem and permit the smoke to escape, in the past firemen have broken windows of the existing structure in order to vent the fire allowing it to quickly burn out, dissipating the smoke generated from the smoldering fire. One of the problems with breaking the windows is that there may be some danger involved and if the area outside of the building is to be cleared of people before the windows are broken there is a loss of time before the venting can take place. It may take as long as 15 or 20 minutes to clear the area before the windows can be broken. Also, once the window is broken, it is not easily or immediately replaced. Moreover, the breaking of the window can only be accomplished from the floor where the fire is, thus making it difficult to reach the area to break the windows especially if the fire is in the upper stores of the building.

Accordingly, an object of the present invention is to provide a fire vent that is releasably maintained in a closed position and that can be released to an open position for venting a fire within a building.

A further object of the present invention is to provide a fire vent comprising a fixed frame and a pivotal frame that is normally retained in a closed position but which may be either manually released or released in response to the detection of heat or smoke.

A further object of the present invention is to provide a fire vent in accordance with the preceding objects wherein the vent may be released to its open position manually from the story therebelow.

Still another object of the present invention is to provide a framing system for use in a building and which is constructed as thin as possible and yet contain all of the operating apparatus associated therewith.

SUMMARY OF THE INVENTION

To accomplish the foregoing and other objects of the present invention, there is provided a vent for a building for venting any fire that may occur in the building. This vent comprises a fixed frame, a moveable frame adapted to fit within the fixed frame when in a closed position, means for pivotally securing the frames in interconnecting relationship, means for urging the moveable frame to an open position, latch means for maintaining the moveable frame in a closed position, and means for releasing the latch means to permit the moveable frame to move to its open position.

In one embodiment, each moveable frame has two latch release members associated therewith, one being disposed above the other. The lower latch member may be depressed to manually release the latch means and thereby permit the moveable frame to swing open. The upper latch release member is operable to release the latch means of a moveable frame in a story thereabove for opening that frame. A shock absorber is suitably secured at either end to the fixed and moveable frames for permitting an easy, gradual opening when the latch means is released. The latch means may also be released automatically from a remote location or can be released in response to a temperature rise within the building, for example.

Another feature of this invention is that the torsion member used for biasing the vent open is preferably designed so that the vent will not open if the outside wind force is greater than some predetermined value corresponding to a predetermined wind velocity of say 30 MPH. With this design criteria the vent does not open unless the wind is below the predetermined velocity even though the vent is released.

BRIEF DESCRIPTION OF THE DRAWINGS

Numerous other objects, features and advantages of the invention should now become apparent upon a reading of the following detailed description taken in conjunction with the accompanying drawings in which.

DETAILED DESCRIPTION

Figure 5:
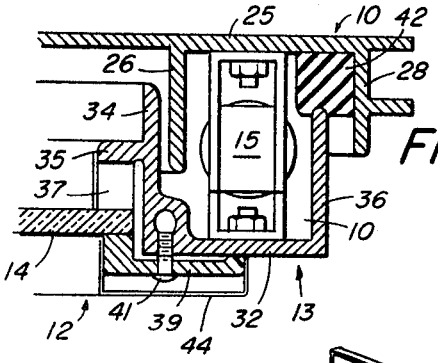
FIG. 5 is a cross-sectional fragmentary view taken along line 5—5 of FIG. 4.
Figure 1:
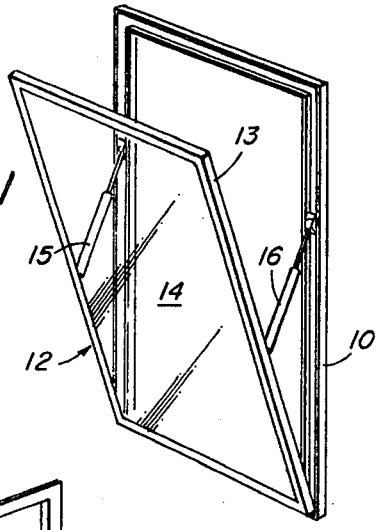
FIGS. 1 and 2 are perspective views taken, respectively, outside and inside the building and showing one arrangement for the fire vent of the present invention.
Figure 2:
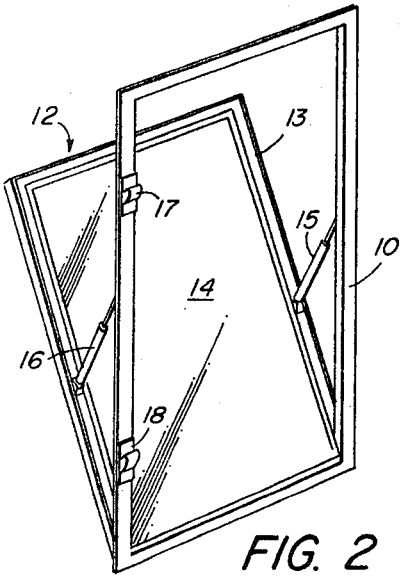

Referring now to the drawings, FIG. 1 shows a vent constructed in accordance with the principles of the present invention as viewed from outside of the building which is to be vented. FIG. 2 depicts the vent of FIG. 1 as viewed from inside the building. The vent generally comprises a fixed rectangular frame 10 which has a generally U-shaped cross-section as indicated in FIG. 5, for example, and a vent 12 including movable frame 13 and panel 44. Frame 13 also preferably has a U-shaped cross-section as indicated in FIG. 5, for example, and panel 14 which may be constructed of glass or clear plastic is disposed therein. FIGS. 1 and 2 show shock absorbers 15 and 16 suitably connected between frame 13 and frame 10. These shock absorbers enable a smooth opening of the vent when it is released and also limit the full open position thereof. The exact location and construction of these shock absorbers is discussed hereinafter with reference to FIGS. 4 and 5.

FIG. 2 also shows release members 17 and 18 which are disposed on frame 10. When the release member 18 is slid downwardly, the latch mechanism of the present invention is released and the vent is allowed to open under control of the shock absorbers. The upper release member 17, in one embodiment, is used to release a vent disposed in a story thereabove. This mode of operation is discussed in more detail hereinafter with reference to FIG. 8.

Figure 3:
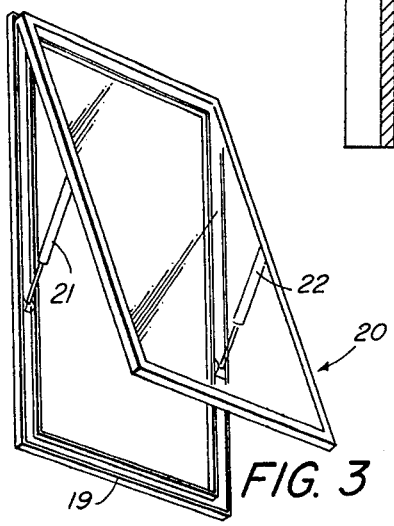
FIG. 3 is an outside perspective view showing an alternate arrangement for the fire vent of the present invention pivoting from the top.

In FIGS. 1 and 2 the frame 13 is pivoted at its lower edge from the frame 10. Alternatively, in the embodiment of FIG. 3 which includes a fixed frame 19 and moveable frame 20, the frame 20 is pivoted at its top edge from frame 19. The embodiment of FIG. 3 may be substantially identical to that shown in FIGS. 1 and 2 wherein both frames have a substantially U-shaped cross-section. FIG. 3 also shows a pair of shock absorbers 21 and 22 which may be of the same type as shock absorbers 15 and 16 of FIGS. 1 and 2.

Figure 4:
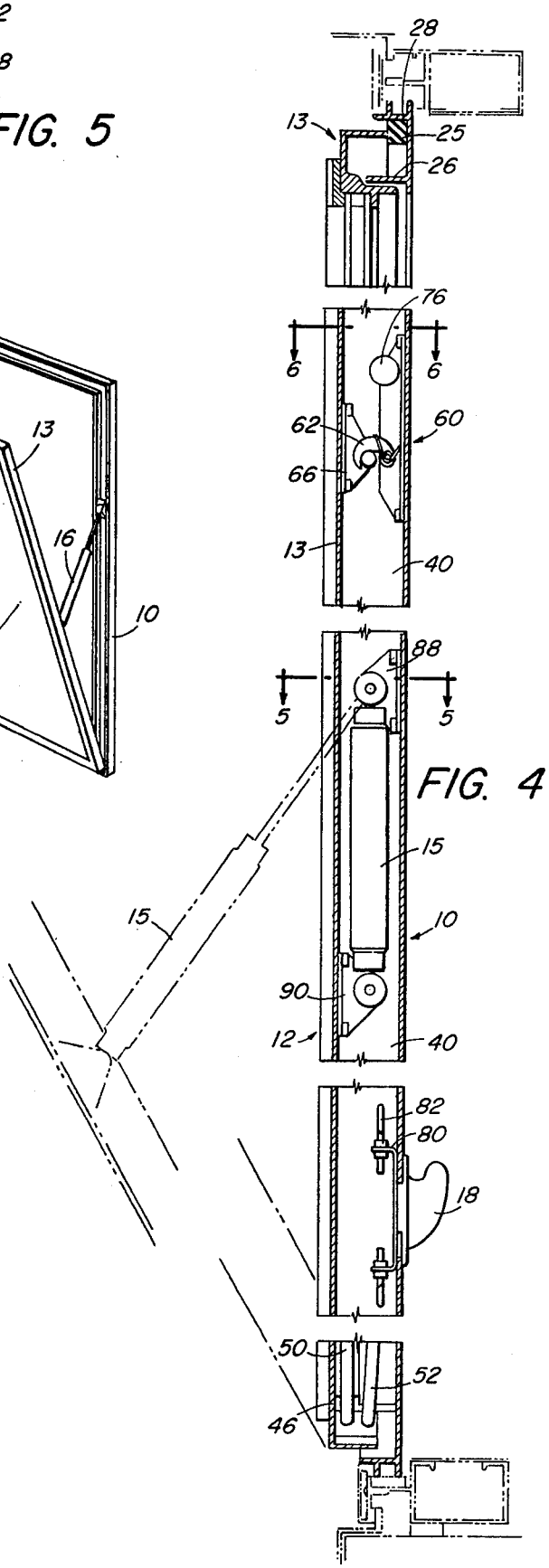
FIG. 4 is a cross-sectional view taken through the fire vent of FIGS. 1 and 2 showing the structure in somewhat more detail.

Referring now to FIG. 4 there is shown a cross-sectional view through the vent when in a closed position for the embodiment shown in FIGS. 1 and 2. FIG. 4 also shows the moveable frame in phantom in its open position with the shock absorber extended. FIG. 5 is a cross-sectional view taken along line 5—5 of FIG. 4 and clearly indicates the cross-sectional configuration of the frame 10 and frame 13.

The frame 10 may be constructed of extruded aluminum and is arranged with a generally U-shaped cross-section as indicated in FIG. 5 having a base wall 25 with walls 26 and 28 extending vertically and integrally therefrom. The frames 10 and 13 with their perpendicularly extending walls define an elongated compartment 40 for containing the mechanisms of the present invention. A gasket 42 provides a seal between frame 10 and frame 13 and may suitably be secured to base wall 25 and perpendicular wall 28.

Figure 6:
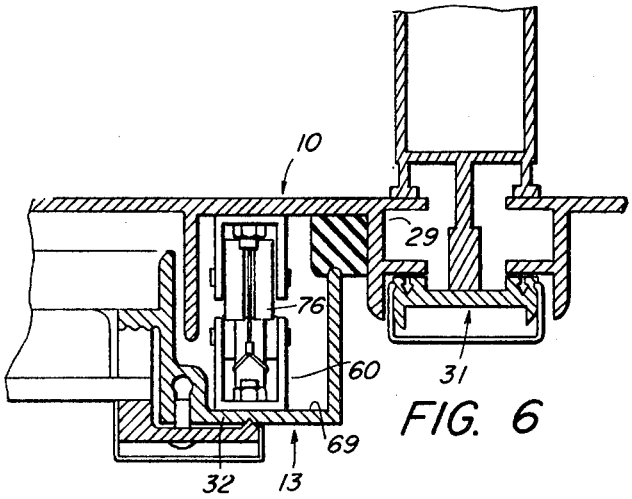
FIG. 6 is a cross-sectional fragmentary view taken along line 6—6 of FIG. 4.

The frame 10 may be secured in any conventional or suitable manner to the building structure. FIG. 6 shows one arrangement for connecting the outer periphery 29 of frame 10 to the building structure 31.

The panel 14 which is shown in FIG. 5 as being constructed of a suitable insulating material such as glass may be secured to frame 13 in the manner shown in FIG. 5. Thus, the perpendicular wall 34 has a flange 35 extending inwardly toward the center of the vent. A gasket or the like 37 may then be inserted between the outer periphery of panel 14 and flange 35. An L-shaped bracket 39 fits against the panel 14 and is secured to window frame 13 by means of a fastener 41. A cover panel 44 may be secured to window frame 13, panel 14, and L-shaped bracket 39 for providing a more esthetic appearance from the outside of the building.

Figure 7:
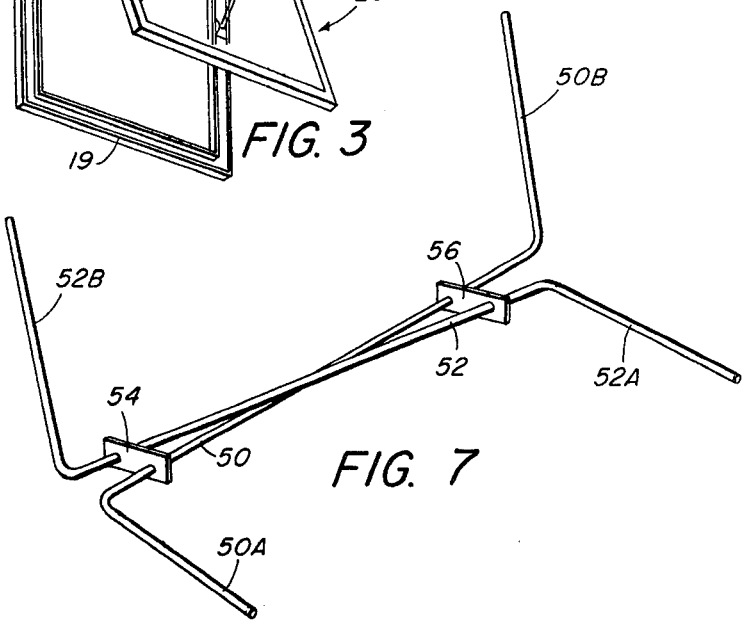
FIG. 7 shows the torsion bars of FIG. 4 in their released position.

The frame 13 is hinged at its bottom end 46 by means of a double torsion bar as depicted in FIG. 7. This double Z-bar normally urges the window away from the frame as indicated in phantom in FIG. 4. U.S. Pat. No. 3,516,210 issued June 23, 1970, clearly indicates the manner in which this double Z-bar is used for tensioning a window or hatch to an open position.

The bias hinge member shown in FIG. 7 comprises a first Z-shaped bar 50 and a second Z-shaped bar 52. The two Z-shaped bars are intercoupled by common connector members 54 and 56. The leg 50A of bar 50 and leg 52A of bar 52 are contained within the U-shaped channel defined by frame 10 and the holding member 54 and 56 are suitably secured to the frame 10. The other arms 50B and 52B of bars 50 and 52, respectively, are contained within the U-shaped channel defined in frame 13. FIG. 7 shows the bars in their relaxed position. However, when the window frame is moved to its closed position the ends of the bars are urged toward each other and a tension is created tending to provide an opening force should the window be released. However, when the window is closed it is maintained in a closed position by means of the latch mechanism 60 shown in FIG. 4 and in a slightly larger view in FIG. 9.

In FIG. 4, for example, only one latch mechanism is shown and for some applications one may be sufficient. However, in a preferred embodiment such as the one shown in FIG. 11 latch mechanisms are disposed on both sides of the vent.

The latch mechanism 60 comprises a hook-shaped member 62 pivotally supported at pivot point 64 from the inner surface of frame 10, and engaging member 66 including a pin 68 for engaging with hook-shaped member 62. Member 66 is suitably secured to the inner surface 69 of wall 32 of window frame 13 (see FIG. 6).

Figure 9:
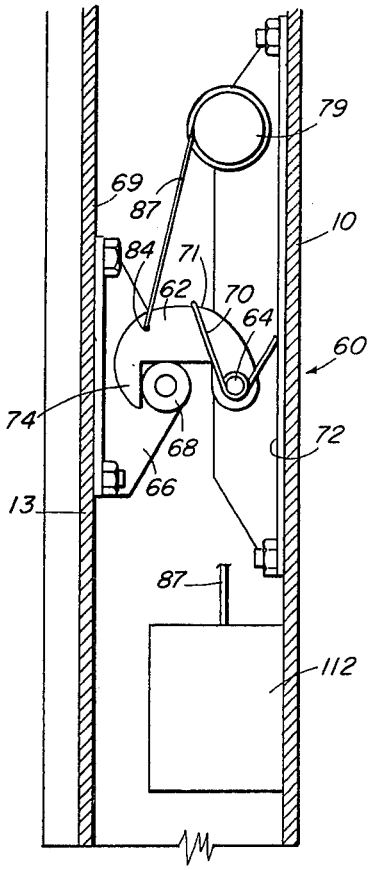
FIG. 9 is a fragmentary cross-sectional view in the vicinity of the latch means of this invention showing an electrically operated means for releasing the latch means.

The member 62 is normally biased to the position shown in FIGS. 4 and 9 by means of a spring 70 which has one end engaged with the top surface 71 of the hook-shaped member and the other end urged against the inner surface 72 of frame 10. Spring 70 is wound about pivot point 64. When the window is closed such as by being closed manually the engaging pin 68 urges the hook-shaped member 62 upwardly and the engaging pin 68 becomes eventually seated behind lip 74 of member 62 thereby securing the vent in a closed position.

Regarding the torsion bar mechanism, it is preferred that the torsion bar such as the one shown in FIG. 7, be constructed so that for a given size panel the moveable frame will not open even after it is released if the outside wind velocity is above a given predetermined threshold level such as 30 miles per hour, for example. This is a desireable feature of the invention in that if there are high winds outside of the building and a vent is permitted to open then the fire could spread very rapidly throughout the entire building. The vents of the present invention are preferably designed so that even if a fireman did release a vent not realizing the direction of velocity of the wind, then the window would not open if the wind were above this predetermined velocity. Also, if the vent is open, it will close itself if the wind exceeds the predetermined velocity. For a given size panel the diameter of the bars can be calculated depending upon the wind speed at which the vent closes. The angle of bend of the Z-bars is another design consideration taken into account in constructing the torsion bars.

For releasing the vent manually there is provided a release member 18 shown in FIG. 4 and associated pulley 76 which is suitably secured in a conventional manner from frame 10. The release member 18 includes a top flange 80 having a cable 82 secured thereto. The cable 82 extends vertically as depicted in FIG. 4, extends about pulley 76 and is secured in aperture 84 (see FIG. 9) of hook-shaped member 62. When the member 18 is depressed downwardly the cable 82 is drawn down causing the hook-shaped member to pivot against the tension of spring 70 thereby disengaging from pin 68. The tension provided by the arrangement shown in FIG. 7 which is incorporated in the structure of FIG. 4 causes the window to pivot from its bottom end to its open position.

FIG. 4 also shows the shock absorber 15 which is mounted in a conventional manner having a top bracket 88 secured to the inner surface of frame 10 and a bottom bracket 90 secured to the inner surface of frame 13. This shock absorber may be of conventional design and as the latch mechanism is released by operation of member 18 the shock absorbers 15 and 16 cause the window to smoothly open. The shock absorbers also limit the final open position of the window.

Referring now to FIG. 6 there is shown a cross-sectional view taken along line 6—6 of FIG. 4 showing the frame 10 and frame 13 as being substantially the same as discussed previously with reference to FIG. 5. FIG. 6 also shows the pulley 76 and the latch mechanism 60 which have been discussed previously in detail with reference to FIG. 4.

Figure 8:
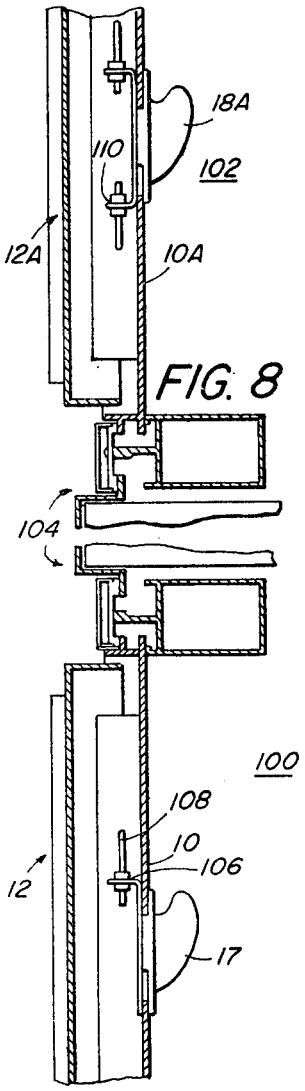
FIG. 8 is a cross-sectional view through adjacent wall vents disposed on separate floors of a building showing the manner in which a wall vent is released from therebelow.

In accordance with another aspect of the present invention, as previously mentioned with reference to FIG. 2, each frame 10 has associated therewith two actuating or release members 17 and 18. The member 18 shown in FIG. 2 is for releasing the vent associated with the frame, whereas the member 17 is for releasing a vent thereabove. The cross-sectional view of FIG. 8 clearly indicates this manner of operation. In FIG. 8, there is shown a frame 10 and vent 12 disposed at a first story 100 and a second frame 10A and vent 12A disposed at a story 102 disposed thereabove. Conventional building structure 104 may be disposed intermediate the horizontally arranged wall vents. FIG. 8 shows a release member 17 associated with frame 10. Member 17 has a flange 106 for securing a cable 108 thereto. This cable couples through the structure 104 to a bottom flange 110 associated with release member 18A. Thus, when member 17 is depressed at story 100, the cable 108 is pulled downwardly causing release member 18A to be depressed. This, in turn, causes the latching mechanism associated with frame 10A and vent 12A to be released causing the vent 12A to open. This action could also have been caused by depression of release member 18A if access to that floor were possible.

Referring now to FIG. 9, most of the components shown therein have been discussed in some detail previously with reference to FIG. 4. The embodiment of FIG. 9 comprises a pulley 79. A cable 87 couples from hook-shaped member 62 about pulley 79 and down to an electrical solenoid 112. When this solenoid is operated the cable 87 is pulled downwardly and the hook shaped member 62 is released opening the window. This solenoid 112 may be actuated from the general area of the window or it can be actuated remotely such as from a control panel located in another portion of the building.

Figure 10:
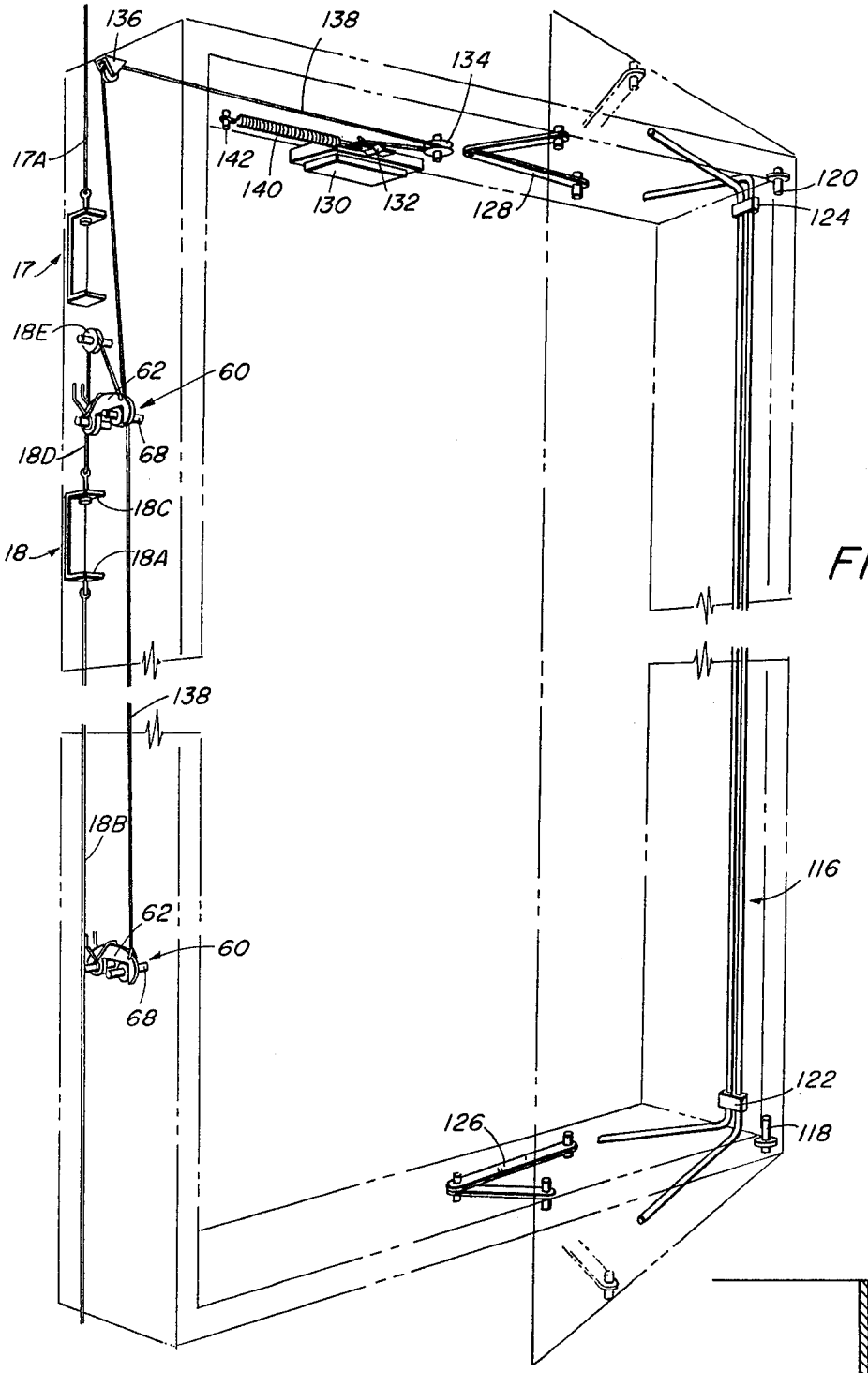
FIG. 10 is a perspective view of another embodiment of the invention partially in phantom with the vent hinged along a side edge.
Figures 11, 12:
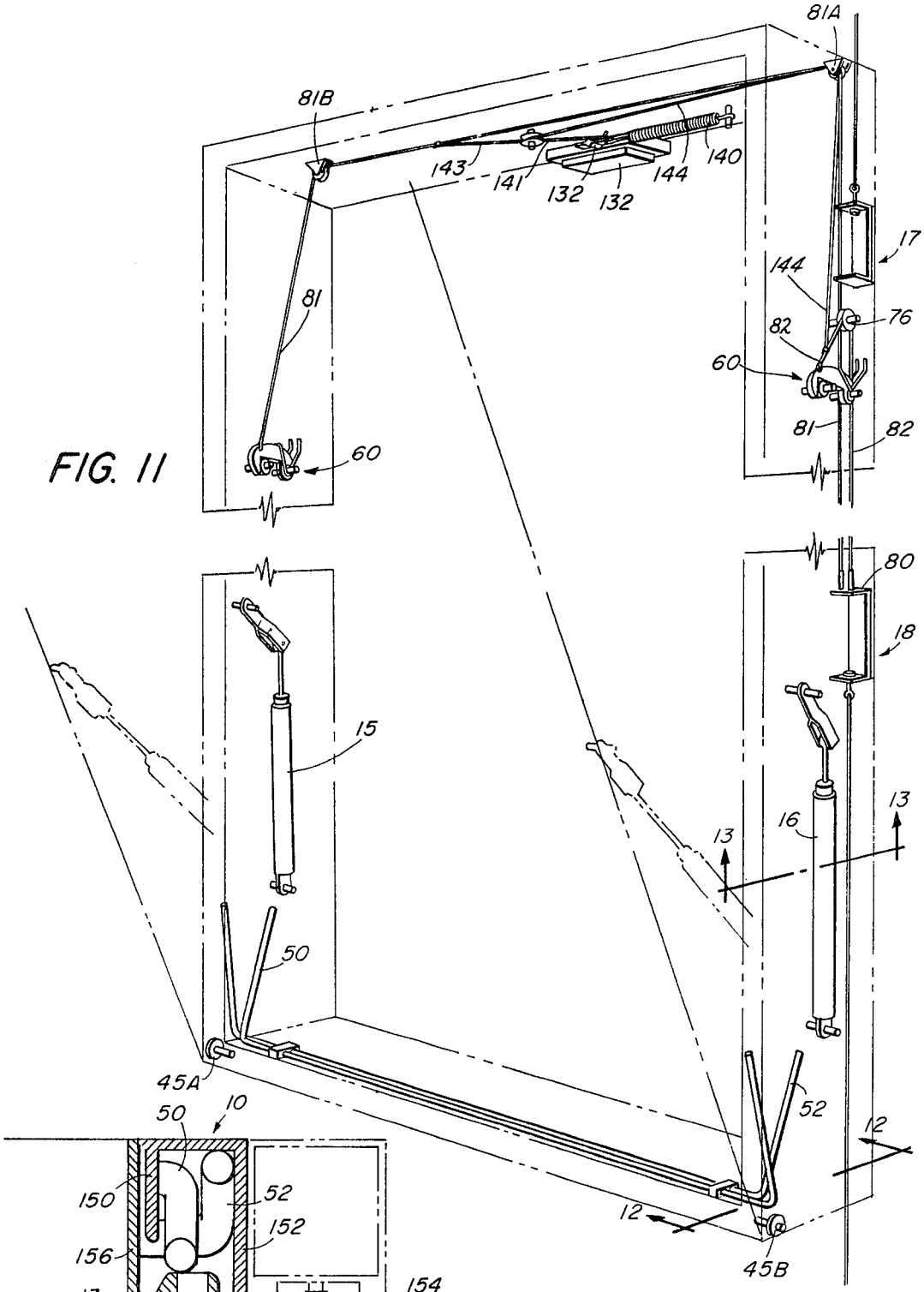
FIG. 11 is a perspective view of a wall vent partially in phantom and similar in construction to the one shown in the cross-sectional view of FIG. 4 clearly indicating the operation of the release means for the wall vent.
FIG. 12 is a cross-sectional view taken along line 12—12 of FIG. 11 showing a thinner frame cross-section than the one shown in FIG. 5, for example.

In FIGS. 10–13, similar reference characters previously used with respect to FIGS. 1–9 shall be used where appropriate. In FIGS. 10 and 11, much of the structural part of the vent have been removed in order to clearly depict the operating apparatus used in association with the vent.

The perspective view of FIG. 10 shows the fixed and movable frames in phantom with the movable frame in an open position. The movable frame is hinged at a side edge in FIG. 10 and a Z-bar torsion bar 116, similar to the one shown in FIG. 7, is used to urge the movable frame to an open position. This embodiment includes hinge pins 118 and 120 and the Z-bar has retainers 122 and 124 disposed at opposite ends. The retainers are fixed to the fixed frame of the vent. The bars 116 are arranged in a similar manner to that disposed with reference to FIGS. 4 and 7.

In the embodiment of FIG. 10 the shock absorbers are replaced by limiting linkages 126 and 128 connected at opposite ends to the fixed and movable frames.

In FIG. 10 there are provided two latch mechanisms 60 which may be identical in design to those shown in FIG. 9. The hook-shaped members 62 associated therewith are pivotally supported to the fixed frame and the engaging pins 68 are suitably supported from the movable frame. FIG. 10 shows the release members 17 and 18. In this embodiment the release member 18 has a bottom flange 18A having a cable 18B secured thereto for actuating the member 18 from a floor therebelow. The top flange 18C of member 18 has a cable 18D extending therefrom around pulley 18E to hook-shaped member 62.

FIG. 10 also shows a smoke or heat response element 130 which may be of conventional design having an electro-thermal link 132 associated therewith. This mechanism has associated therewith pulleys 134 and 136 for accommodating cable 138 which couples from the fusible link 132 over pulleys 134 and 136 to the top hook-shaped member 62. Cable 138 connects to the top hook-shaped member 62 in any suitable manner and continues to the bottom hook-shaped member 62. The thermal link 132 has a spring 140 associated therewith which is in its tensioned position when the link 132 is not broken. If smoke or heat is detected, the sensor activates the electro-thermal link 132 causing it to melt and the spring 140 pulls the cable toward the fixed end 142 of the spring. This causes both hook-shaped members to lift and disengage from their associated pins 68. Similar operation can be provided by depressing release member 18 which in turn causes both hook-shaped members to lift. The bottom hook-shaped member is lifted manually by means of the bottom section of cable 138. The release means 17 also has a cable 17A associated therewith for causing release of a vent disposed thereabove.

Referring now to the perspective view of FIG. 11, this embodiment is quite similar to that previously discussed with reference to FIG. 4, for example. One of the differences is in the use of added pivot members 45A and 45B. In this embodiment the Z-bars can be held by clips similar to the ones shown in FIG. 10. With this type of an arrangement the hinging of the moveable frame is provided by the pivot members and the Z-bars function primarily as a biasing means for urging the moveable frame to its open position.

FIG. 11 also shows the shock absorbers 15 and 16 which may be similar in design to the shock absorbers shown in FIG. 1, for example. FIG. 11 also shows the release members 17 and 18 and latch mechanisms 60, one disposed on each side of the vent. The latch mechanism 60 shown on the right in FIG. 11 is arranged substantially identically as the one discussed in FIG. 4. However, with the two latch arrangements shown in FIG. 11 the release member 18 with its top flange 80 accommodates a cable 81 in addition to the previously discussed cable 82. The cable 81 extends from flange 80 through pulleys 81A and 81B appropriately mounted to the fixed frame, to the left hand latch mechanism 60. When the release member 18 is depressed both cables 81 and 82 are pulled down causing both latch mechanisms 60 to lift permitting an opening of the moveable frame of the vent.

FIG. 11 also includes means responsive either to smoke or heating causing a release of the moveable frame. This heat or smoke element 130 may be similar to the one shown in FIG. 10 and includes an electro-thermal link 132 and spring 140. In this embodiment a cable 141 connects to the fusible link and has its ends split into sections 143 and 144, Section 143 is coupled to cable 81. Section 144 extends back thru pulley 81A and is attached to cable 82 just above latch 60. If link 132 is melted the spring 140 causes the cable 141 to be pulled toward the fixed end of the spring and the segments 143 and 144 of the cable cause release of both latch mechanisms 60 by pulling on cables 81 and 82.

FIG. 12 shows a cross-sectional view taken along line 12—12 of FIG. 11. It discloses in this embodiment that the fixed frame 10 and moveable frame 13 are thinner than in the embodiment shown in FIG. 5, for example. In this way, the vent is not too bulky and does not distract from the appearance of a regular window.

As indicated in FIG. 12 the fixed frame is substantially U-shaped including legs 150 and 152. Leg 152 is appropriately connected to the surrounding building construction 154. The moveable frame includes an elongated leg 156 which fits adjacent leg 150 and has a body portion 158 for accommodating a panel 14. In FIG. 12 this cross-sectional view shows the Z-bars 50 and 52 appropriately situated in the compartment defined by the two frames.

Figure 13:
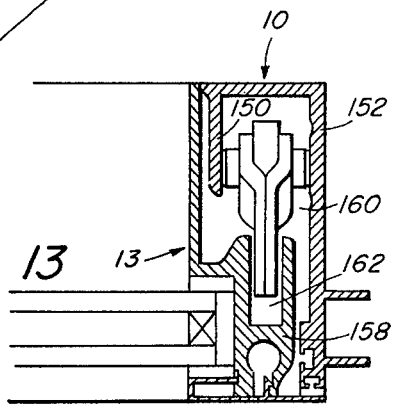
FIG. 13 is a cross-sectional view taken along line 13—13 of FIG. 11.

FIG. 13 is a cross-sectional view similar to that shown in FIG. 12 but taken along line 13—13 of FIG. 11. This embodiment shows the fixed frame 10 and the moveable frame 13 of substantially the same configuration as shown in FIG. 12. In this cross-sectional view there is shown a shock-absorber 160 fastened at one end between legs 150 and 152 and connected at the other end in U-shaped channel 162 in body 158.

Figure 14:
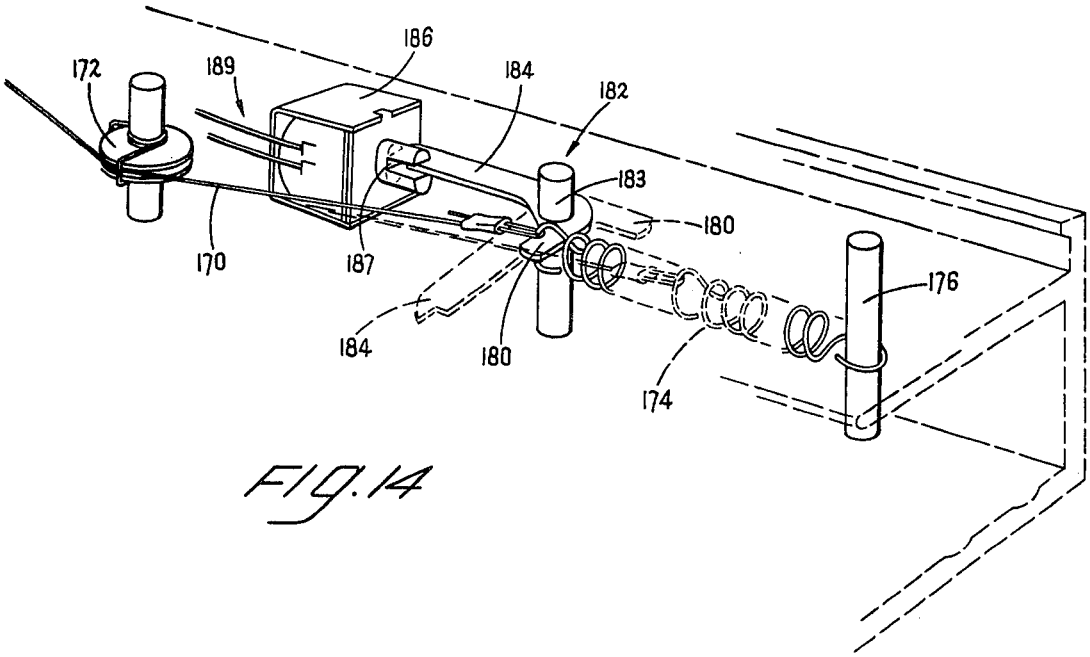
FIG. 14 is a perspective view of another arrangement for releasing the vent.

FIG. 14 shows another electrical arrangement for releasing the latch mechanism such as the one shown in FIG. 11. The cable 170 shown in FIG. 14 is analogous to the cable 141 of FIG. 11. This cable extends about a pulley 172 suitably supported in the frame and is tied at its end to spring 174. The spring has its other end fixed to post 176. The moveable end of the spring also engages with arm 180 of pivot member 182. The other arm 184 of member 182 is engageable with solenoid 186.

In the solid outline position of FIG. 14 arm 184 is held by the output shaft 187 of the solenoid which is in its extended position. The arm 180 holds the spring in its tensioned position. When the solenoid is actuated via lines 189 by means of an electrical signal from a switch or sensor, arm 184 disengages from shaft 187 and member 182 rotates about pin 183. The spring disengages from arm 180 and cable 170 is pulled to the right as viewed in FIG. 14 causing a release of a latch mechanism associated therewith.

Figure 15:
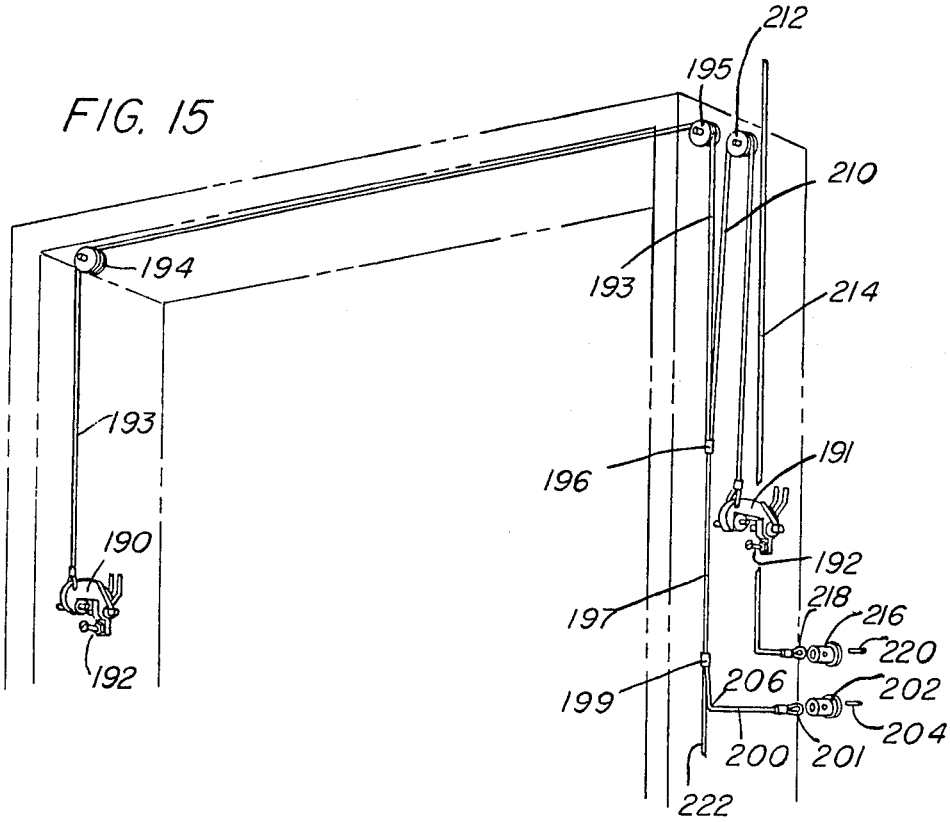
FIG. 15 is a perspective view of a wall vent partially in phantom and showing an alternate release mechanism.

FIG. 15 shows a view similar to that shown in FIG. 11, and discloses a different release mechanism. In FIG. 15, the frame is shown in phantom and primarily only the structure associated with the release mechanism is shown in its position relative to the frame. The release mechanism includes latch mechanisms 190 and 191 which are substantially identical to the latch mechanism shown in FIG. 11. However, each of the latch mechanism shown in FIG. 15 does include an adjusting screw 192 which can be used to adjust the closed position of each of the latch mechanisms.

A cable 193 couples to latch mechanism 190 and extends about pulleys 194 and 195 which are suitably supported from the fixed frame. The cable 193 is tied by a crimp device 196 to a downwardly extending cable section 197. Cable section 197 also couples to crimp device 199 which has extending therefrom cable section 200. The end of cable section 200 ties in a loop 201 which fits within handle 202 by means of a securing pin 204 which is shown exploded from the handle. The cable section 200 is bent at point 206 as shown in FIG. 15 and at that point extends through a hole in the frame which is not shown in FIG. 15.

The handle 202 is adapted to appropriately fit within a recess in the frame and is pulled away from the frame in order to actuate the release mechanism.

Another cable section 210 extends from crimp device 196 over pulley 212 and is secured to the other latch mechanism 191. Thus, when handle 202 is pulled the cable sections 193 and 210 cause upward pivoting of the respective latch mechanisms 190 and 191 to permit release of the movable frame and opening of the vent.

FIG. 15 also shows the cable 214 connecting to second handle 216. The bottom end of cable 214 terminates in a loop 218 which is secured to handle 216 by pin 220. Handle 216 may be pulled to release a latch mechanism in the unit above the one shown in FIG. 15. In the same respect, the unit shown in FIG. 15 can be released from the vent unit below by means of a handle structure like handle 216 shown in FIG. 15 for pulling downwardly on the cable section 222 which couples to crimp device 199. It can be seen that by pulling down on cable section 222 both of the latch mechanisms are released in a similar manner to the pulling out of handle 202.

Figure 16:
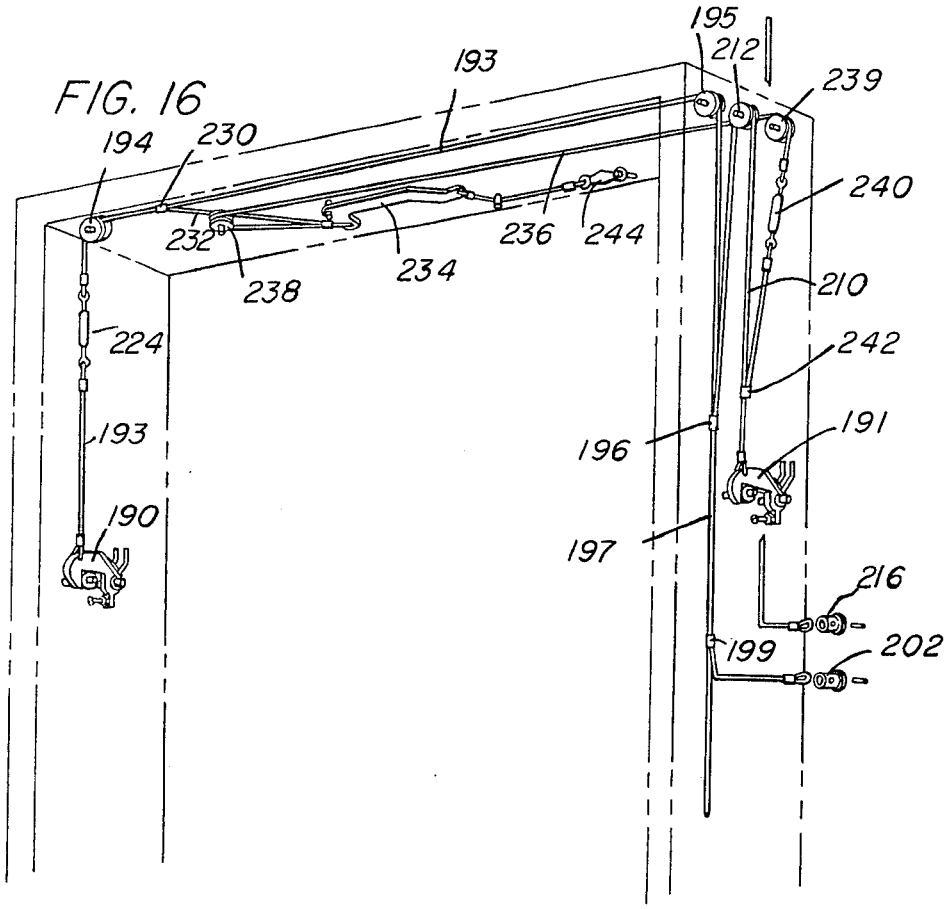
FIG. 16 is a perspective view similar to that shown in FIG. 15 with still a further release mechanism.

FIG. 16 shows an arrangement similar to that shown in FIG. 15 and like reference characters will be used in FIG. 16 as they apply to the like parts shown in FIG. 15. One of the differences between the structure shown in FIG. 16 and that shown in FIG. 15 is that the cable 193 has disposed therein a turn-buckle device 224 which permits fine adjustment of the tension that is to be maintained in the main cable 193 which is shown extending about pulleys 194 and 195. The operation of the latch mechanisms 190 and 191, from the handle 202, is substantially identical in FIG. 16 as that discussed with reference to FIG. 15. However, in FIG. 16, a crimp device 230 has a cable 232 extending therefrom which connects to swivel bar 234. The swivel bar 234 may be operated in different manners to also cause release of the latch mechanisms. Thus, another cable 236 also extends from pivot bar 234 about pulleys 238 and 239, via a turn-buckle arrangement 240 to a crimp device 242 which joins with cable 210 shown previously in FIG. 15 as extending to the latch mechanism 191. The turn-buckle arrangement 240 provides fine adjustment for the cable mechanism so that the slack in the different cables can be maintained about the same so that under the different conditions of release, the latch mechanisms 190 and 191 will be substantially concurrently released.

Figure 17:
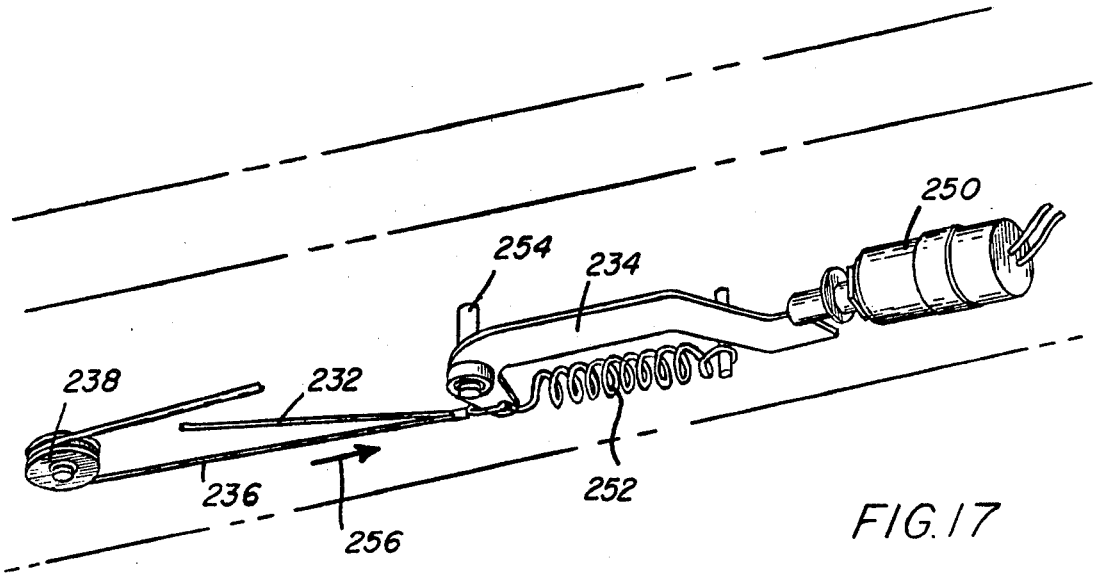
FIG. 17 shows a portion of the release mechanism shown in FIG. 16 adapted for electrical operation.

In FIG. 16, the pivot bar 234 is releasable by means of a fusible link 244. When this fusible link opens, the pivot bar 234 is pivoted to pull the cable sections 232 and 236 and cause release of the latch mechanisms 190 and 191, respectively. In this connection, reference is now made to FIG. 17 which shows, in some what more detail, the pivot bar 234 and pulley 238. In the arrangement of FIG. 17, the pivot bar 234 is released by means of a solenoid 250. However, as shown in FIG. 16, the pivot bar can also be connected to a fusible link for actuation thereby.

In either event, that is if either the solenoid 250 is operated or the fusible link 244 opens, the pivot bar 234 under the bias of spring 252 causes the bar to rotate about pin 254 causing the cables 232 and 236 to be pulled in the direction of arrow 256.

What is claimed is:

1. A system for venting a building having a plurality of floors, said system comprising;

a first vent disposed at one floor of the building and including a fixed frame, a movable frame adapted to fit within the fixed frame when in a closed position and panel means for insertion into said movable frame, means for pivotally securing said movable frame to said fixed frame, means for urging said movable frame to an open position, latch means for maintaining said movable frame in the closed position, a first release member mounted on the fixed frame of said first vent for releasing the latch means of the first vent to permit the movable frame to move to its open position, another vent disposed at another floor of the building and including a fixed frame, a movable frame adapted to fit within the fixed frame when in a closed position, panel means for insertion into said movable frame, means for pivotally securing said movable frame to said fixed frame, means for urging said movable frame to an open position, and a latch means for maintaining said movable frame in the closed position, and a second release member mounted on the fixed frame of said first vent, and means coupling from the second release member of the first vent to the said another vent for releasing the latch means of the said another vent.

2. A system of claim 1 wherein said means coupling from the second release member includes a cord extending between the second release member of the first vent and said another vent and responsive to operation of the second release member to pull the cord and release the latch means of the said another vent.

3. The system of claim 1 wherein the first and said another vents are disposed in adjacent floors.

4. A system as set forth in claim 1 wherein each of said vents has a first and second release member, said vents being disposed on adjacent floors.

5. A system as set forth in claim 4 wherein the first release member of the first vent released only the first vent while the second release member of the first vent released only the said another vent.

6. A system as set forth in claim 4 wherein said means coupling from the second release member of the first vent includes a cord means coupling to the first release member of the said another vent.

7. A system as set forth in claim 4 wherein said first release member of each vent is disposed at a lower position on the fixed frame than the second release member.

8. A system as set forth in claim 7 wherein said means coupling from the second release member of the first vent includes a cord means coupling to the first release member of the said another vent, said first release member including a slide handle and a support bracket secured to the slide handle for holding the cord means from an adjacent vent below said first vent, and a second cord means for operating the latch means of the first vent, and said second release member including a slide handle and a support bracket secured to the slide handle for holding the cord means extending to an adjacent vent above the first vent.

* * * * *